US010650761B2

(12) United States Patent
Lee

(10) Patent No.: US 10,650,761 B2
(45) Date of Patent: May 12, 2020

(54) DISPLAYING IMAGE ON LOW REFRESH RATE MODE AND DEVICE IMPLEMENTING THEREOF

(71) Applicant: LG Display Co., Ltd., Seoul (KR)

(72) Inventor: Hojun Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/111,666

(22) Filed: Aug. 24, 2018

(65) Prior Publication Data

US 2019/0122623 A1 Apr. 25, 2019

(30) Foreign Application Priority Data

Oct. 19, 2017 (KR) ..... 10-2017-0135546

(51) Int. Cl.
*G09G 3/36* (2006.01)

(52) U.S. Cl.
CPC ..... *G09G 3/3614* (2013.01); *G09G 2310/08* (2013.01); *G09G 2320/0204* (2013.01); *G09G 2320/0247* (2013.01); *G09G 2330/021* (2013.01); *G09G 2340/0435* (2013.01)

(58) Field of Classification Search
CPC ..... G09G 3/3614; G09G 2330/021; G09G 2310/08; G09G 2320/0247; G09G 2320/0204; G09G 2340/0435
See application file for complete search history.

(56) References Cited

U.S. PATENT DOCUMENTS

2013/0314451 A1* 11/2013 Kim ..... G09G 5/08 345/690
2014/0320465 A1* 10/2014 Oh ..... G09G 3/3688 345/204
2015/0002381 A1* 1/2015 Fujioka ..... G09G 3/3614 345/87
2015/0243253 A1* 8/2015 Sone ..... G09G 3/2096 345/209

* cited by examiner

*Primary Examiner* — Brent D Castiaux
(74) *Attorney, Agent, or Firm* — Polsinelli PC

(57) ABSTRACT

The present disclosure relates to a method of displaying an image on a low refresh rate mode and a display implementing the same, and the display in accordance with an exemplary aspect of the present disclosure includes a timing controller to set D display frame and S skip frame in N frame configuring a group of an unit on the low refresh rate mode and control a polarity change of the pixels in the skip frame according to a ratio of D and S.

13 Claims, 10 Drawing Sheets

FIG. 3

| Symbol | Description | Min Max | Unit |
|---|---|---|---|
| P1/2/3 | Period1/2/3 | 0~120 | Frame |
| D1/2/3 | how many feame will display during period1/2/3? | 1~6 | Frame |
| S1/2/3 | how many feame will skip during period1/2/3? | 0~5 | Frame |
| Polarity | Period1/2/3 Setting to Hold on/change Polarity | 0 | Hold on |
| | | 1 | change |

DISPLAYING IMAGE ON LOW REFRESH RATE MODE AND DEVICE IMPLEMENTING THEREOF

CROSS REFERENCE TO RELATED APPLICATION

This application claims priority to and the benefit of Korean Patent Application No. 10-2017-0135546, filed on Oct. 19, 2017, which is hereby incorporated by reference in its entirety.

BACKGROUND

Field of the Disclosure

The present disclosure relates to a method for displaying an image on a low refresh rate mode and a display for implementing the same.

Description of the Background

A display (or a display device) visually displays data, and includes a Liquid Crystal Display device, an Electrophoretic Display, an Organic Light Emitting Display, an inorganic Electro Luminescent (EL) Display, a Field Emission Display, a Surface-conduction Electron-emitter Display, a Plasma Display, and a Cathode Ray Display.

A Liquid Crystal Display (LCD) is an electronic device to transmit various electrical information generated from various components into visual information by using a change in a liquid crystal transmittance according to an applied voltage. The Liquid Crystal Display has the advantages of a possibility of a mass producing, an ease of a driving means, an implementation of high quality, and a realization of a large area screen and is in a widely used state as an alternative means which can overcome a disadvantage of conventionally used Cathode Ray Tube (CRT).

Meanwhile, when a light emitting layer is formed between two electrodes different from each other and an electron generated from one of the electrodes and a hole generated from the other electrode are injected inside the light emitting layer, an Organic Light Emitting Display is a display which the injected electron and the hole are combined to produce an exciton, and the produced exciton transits from the excited state to the ground state and emits a light to display an image, and can implement a low power driving, a thin structure, and a superior image.

The above-described display can be displayed by dividing moving images and static images, in displaying one image. For the moving images, a large number of frames can be displayed within a certain time with a high frame rate. For the static images, a smaller number of frames can be displayed within a predetermined time according to a low frame rate.

However, these frame rates can be generated which the static images and the moving images are repeated. In addition, since there is a possibility that the pixels configuring the display is degraded due to the change of the repeated frame rates, there needs a method for solving it.

SUMMARY

The present disclosure presents a method for controlling a display on a low refresh rate mode and a device for implementing the same.

The present disclosure presents a method for reducing a power consumption by having a skip frame at various ratios on a low refresh rate mode and a display implementing the same.

The present disclosure presents a display in which a flickering or a DC component is not accumulated on a low refresh rate mode.

The present disclosure are not limited to the above, and the advantages of the present disclosure which are not mentioned can be understood by the following description, and can be more clearly understood by the aspect of the present disclosure. In addition, it will be easily seen that and the advantages of the disclosure may be realized by means indicated in claims and a combination thereof.

The display in accordance with an exemplary aspect of the present disclosure includes a timing controller to set D display frame and S skip frame in N frame configuring a group of a unit in a low refresh rate mode, and control a polarity change of the pixels of the skip frame according to a ratio of D and S.

In the display in accordance with other aspect of the present disclosure, the timing controller changes a polarity of each pixel at a start time point of one or more skip frames on a low refresh rate mode in a frame skip method.

A method of displaying an image on a low refresh rate mode for a display in accordance with an exemplary aspect of the present disclosure includes selecting the low refresh rate mode in a frame skip method for a timing controller, setting a polarity change mode in one or more skip frames of the low refresh rate mode by the timing controller, and controlling the polarity of the pixels at a start time point of each of one or more skip frames according to the polarity change by the timing controller.

The method of displaying the image on a low refresh rate mode for the display in accordance with other aspect of the present disclosure includes changing the polarity of the pixels at a start time point of one or more skip frames by the timing controller.

When the present disclosure is applied, a power consumption can be reduced by variously adjusting a ratio of the display frame and the skip frame on a low refresh rate mode such as a frame skip.

In addition, when the present disclosure is applied, a skip frame longer than a display frame can be implemented, which can greatly reduce the power consumption.

The effect of the present disclosure is not limited to the effect described above, and those skilled in the art of the present disclosure can easily derive various effects of the present disclosure in a constitution of the present disclosure.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings:

FIG. 3 is a view illustrating a table where information for setting a frame skip mode is stored in accordance with an exemplary aspect of the present disclosure;

DETAILED DESCRIPTION

Figure 1:
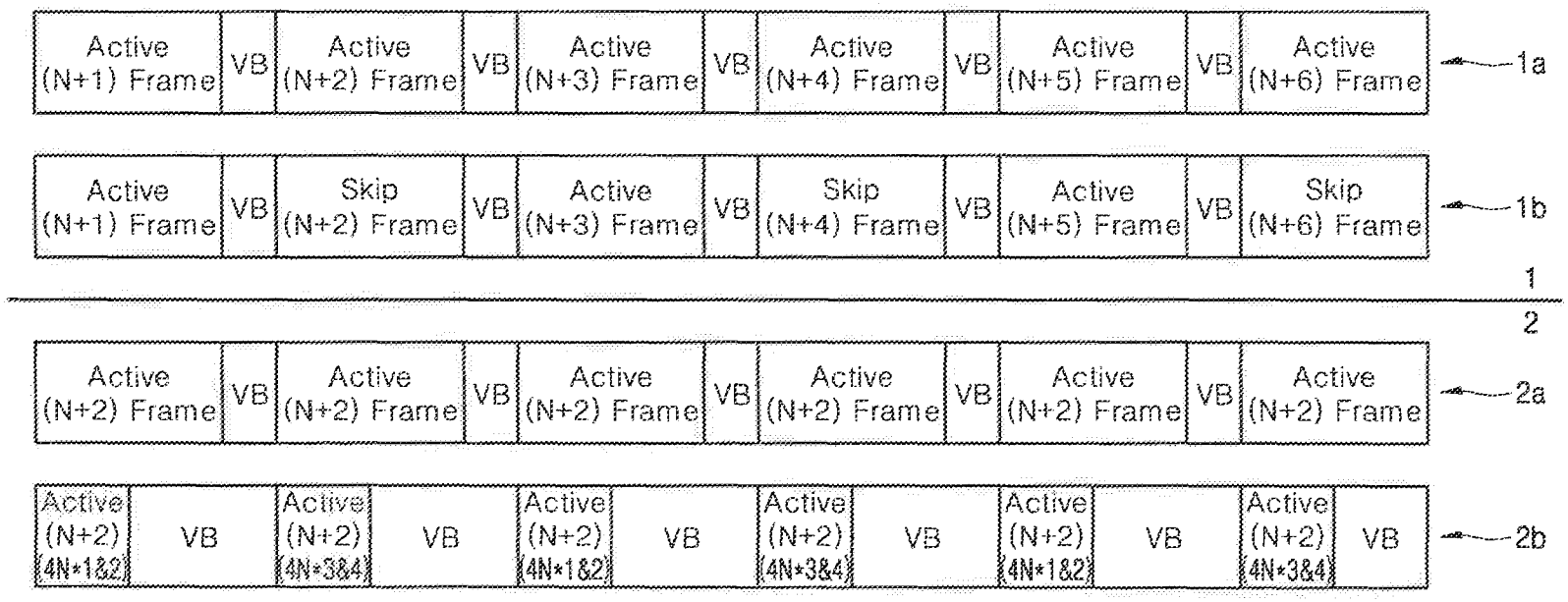
FIG. 1 is a view illustrating a low refresh rate (LRR) driving method.

Hereinafter, the aspects of the present disclosure will be described in detail with reference to the drawings so that those skilled in the art can easily perform the present disclosure. The present disclosure may be embodied in many different forms and is not limited to the aspects described herein.

In order to clearly describe the present disclosure, the part that is not related to the description is omitted, and the same reference numeral is used for the same or similar component throughout the specification. Further, some aspects of the present disclosure will be described in detail with reference to exemplary drawings. In adding the reference numeral to the component of each drawing, the same components may have the same reference numeral as possible even if the components are displayed on the different drawing. In addition, in describing the present disclosure, when a specific description of the related known constitution or a function is determined to obscure the gist of the present disclosure, the detailed description thereof can be omitted.

Hereinafter, a display will be mainly described with regard to an Liquid Crystal Display or Organic Light Emitting Display, but the present disclosure is not limited thereto. The present disclosure can be applied to various displays to apply a sub-frame and a digital driving such as an electronic ink panel other than the Liquid Crystal Display or Organic Light Emitting Display.

In describing the component of the present disclosure, the terms such as a first, a second, A, B, (a), (b), etc. can be used. These terms are only intended to distinguish that component from other component, and the nature, the order, the sequence, or the number of the corresponding component is not limited by the terms. When any component is described as being "linked", "coupled", or "connected" to other component, it will have to be understood that the component may be directly linked or connected to other component, whereas other component is 'interposed' between each component, or each component can be "linked", "coupled" or "connected" through other component.

In addition, although the component can be described with subdivided for the convenience of an explanation in implementing the present disclosure, these components may be implemented in one device or a module, or one component may be implemented with divided in multiple devices or modules.

In the present specification, a display frame rate is changed in order to reduce a power consumption when there is little change in an input image. When displaying a moving image, the display operates in a basic drive mode. The timing controller of the display confirms that a predetermined low refresh rate condition is satisfied, and outputs an image on a low refresh rate mode when a static image or a situation that meets a predetermined condition occurs. It is called a Low Refresh Rate (LRR).

FIG. 1 is a view illustrating an LRR driving method. A reference numeral 1 shows a frame skip. A reference numeral 1*a* shows an input frame and a reference numeral 1*b* shows a display frame. Although the input frame is from (N+1) frame to (N+6) frame as presented in FIG. 1, only half of the output frame is active and the other half thereof is skip as presented in 1*b*. Vertical Blank (VB) means a section which an image is not displayed.

A reference numeral 2 shows an LRR interlace method. A reference numeral 2*a* shows that the same frame (N+2), which is a static image, is continuously being input. On the other hand, when the LRR is applied, (N+2) frames can be displayed and alternately displayed in half of the entire lines of the corresponding frame. For example, as indicated by a reference numeral 2*b*, after 4N+1, 2 lines are displayed, and after VB, 4N+3, 4 lines are displayed, which is repeated.

As described above, the LRR driving method can be driven by dividing into an interlace method and a frame skip method. In the LRR driving method, the ratio of a frame to be skipped and a frame to be displayed can be different even in the frame skip.

That is, in order to use a frame skip mode on the low refresh rate mode which is an LRR drive, a frame rate on the low refresh rate mode can be configured to be different from that in the basic drive mode. Therefore, in the present disclosure, the frame rate can be configured to be different or a display/skip rate can be configured differently in the low refresh rate mode. Meanwhile, in this process, a polarity may be continued without being changed according to a ratio of a skipped section and a displayed section, which may cause a decrease in visibility such as a flickering of a screen. The present disclosure provides a device and a method for preventing this. It will be described in more detail.

Figure 2:
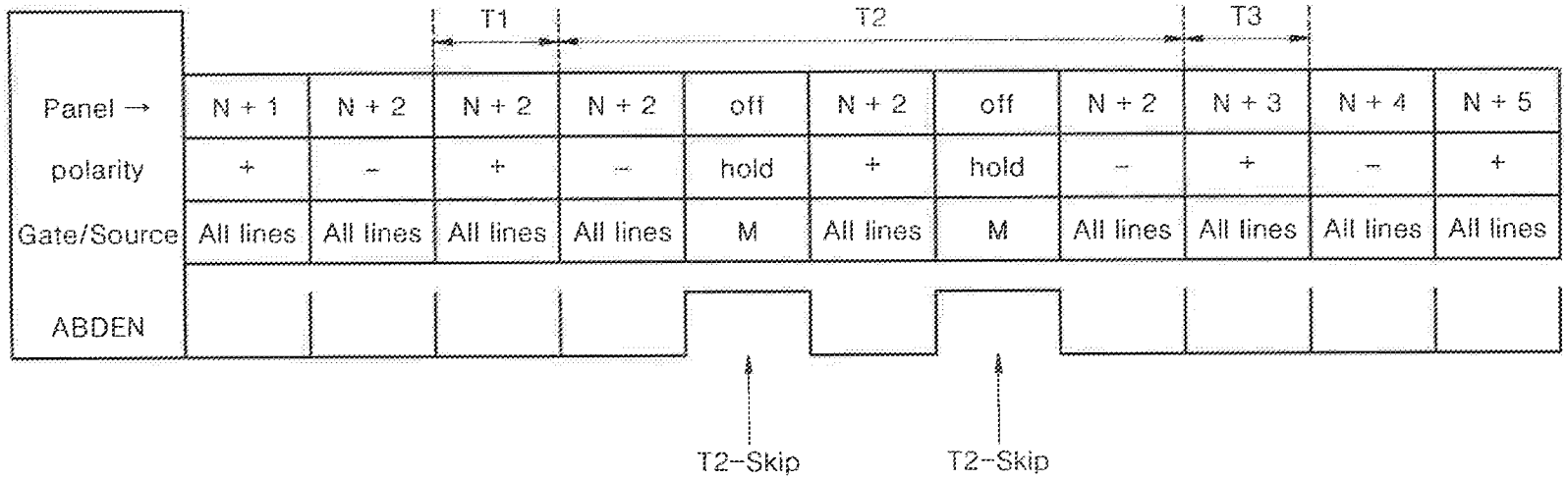
FIG. 2 is a view illustrating a process of skipping a frame display on a panel and maintaining a polarity.

FIG. 2 is a view illustrating a process which skips a frame display on a panel and maintains a polarity. A skip section can be divided into T1, T2, and T3 again, where T1 means a waiting time for performing an LRR operation. T2 means a time to actually perform the LRR operation. T3 means a waiting time for terminating the LRR operation.

The frame applied to the panel is continued by N+1, N+2, . . . , N+5, etc. Among them, when N+2 is continued for 7 frames times as a static image, an LRR operation in which an image is not displayed can be performed in some frame section in an area indicated by T2. FIG. 2 shows the frame skip in the LRR operation.

The polarity for each frame is changed to + and −. The polarity of the area where the frame is not displayed (off), that is, an area indicated by T2_Skip maintains (hold) the polarity of a proceeding frame (a frame which an image is displayed). Here, a gate signal is masked not to be displayed and an ABDEN (Analog Block Disable Enable) as a source signal is applied to maintain a high state in an off time point.

An LRR method shown in FIG. 2 can be operated in an operation to skip the frame or the interlace method shown in the reference numeral 2*b* of FIG. 1, and reduces the power consumption of a display module, e.g., liquid crystal module (LCM), OLED display module, by adjusting the gate signal and the source signal. The adjustment of the gate signal can perform a gate masking in a section in which separate gate signal is not displayed to the panel, that is, in a section in which a charging is not required.

The adjustment of the source signal may apply an ABDEN signal which is enabled in a section in which a data signal is not displayed or data signal is not outputted, that is, in a section in which a charging is not required. In FIG. 2, in the frame in which an entire line is displayed, the ABDEN maintains a low state and performs a rising at a time of changing from a display frame to a skip frame, and a falling at a time of changing from a skip frame to a display frame. In addition, the ABDEN maintains a high state at a time point at which an image is not displayed (T2_Skip). Of course, the high/low of the ABDEN signal and an operation of the skip frame can be set differently, and the present disclosure is not limited thereto.

On the other hand, when the LRR operates in the frame skip method, the frame rate can be changed. For example, the displayed section and the skipped section can be adjusted. In this process, in a case that the ratio of the displayed section and the skipped section makes the polarity biased, there needs a process capable of driving by changing this polarity. For example, when the ratio of a display section and a skip section is 2:1 or 1:2, a polarity bias problem arises. A configuration for changing the polarity in the display section or the skip section in accordance with the aspects of the present disclosure will be described in order to solve the polarity bias.

FIG. 3 is a view illustrating a table which information for setting a frame skip mode is stored in accordance with an exemplary aspect of the present disclosure. The table may be embedded in a timing controller 140 of FIG. 4.

As presented in FIG. 3, four elements such as Period (P), Display (D), Skip (S), and Polarity (polarity) can be set as the parts that can be set in order to implement a frame skip. In view of 4 elements more detail, P means the length of a frame section and an unit is a frame. D means the number of a displayed frame section and S means the number of a skipped frame section.

The specific ranges of D, S, and P in FIG. 3 are shown in the aspects, but the present disclosure is not limited thereto.

In addition, the polarity shows how to control the polarity in a skip frame on a low refresh rate mode. In a skip mode, a timing controller can select a "Hold on" method which maintains the polarity and the "Change" method which changes the polarity. Therefore, the present disclosure comprises indicating whether to change the polarity even in the skip frame.

Figure 4:
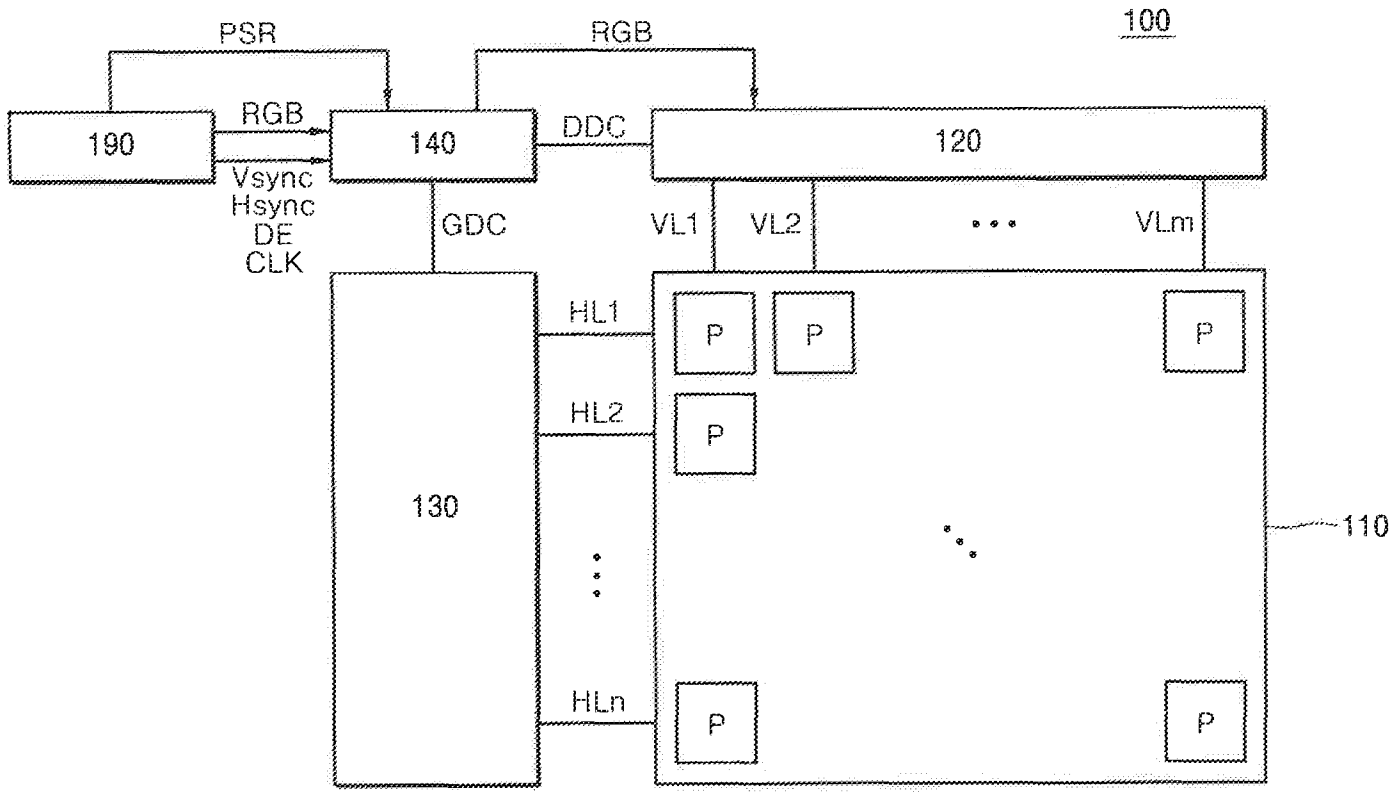
FIG. 4 is a schematic view illustrating a component of a liquid crystal display in accordance with an exemplary aspect of the present disclosure.

FIG. 4 is a view illustrating a component of a Liquid Crystal Display in accordance with an exemplary aspect of the present disclosure.

A liquid crystal display device 100 includes a display panel 110, a timing controller 140, a data driver 120, a gate driver 130, and a host system 190. According an exemplary aspect of the present disclosure, the plurality of pixels is arranged in the display panel 100, in which the gate lines and data liens are defined as crossed. The display panel 110 includes a liquid crystal layer formed between two substrates. The gate driver 130 applies a first signal to the gate line. Data driver 120 applies a second signal to the data line. By these controls, the liquid crystal layer of the pixel operates, and the display panel 110 displays an image.

The liquid crystal layer of each pixel operates by a signal applied from the data driver 120 and the gate driver 130. The display panel 110 applicable to the present disclosure can be implemented in any liquid crystal mode as well as a twisted nematic (TN) mode, a vertical alignment (VA) mode, an In plane switching (IPS) mode and a fringe field switching (FFS) mode.

According an exemplary aspect of the present disclosure, the timing controller 140 receives a digital video data (RGB) of an input image from a host system 190 through a Low Voltage Differential Signaling (LVDS) interface method or a Transition Minimized Differential Signaling (TMDS) interface method, and supplies the digital video data (RGB) of the input video to data driver 120. The timing controller 140 arranges the digital video data (RGB) which is input from the host system 190 in accordance with an arrangement configuration of a pixel array, and supplies data to the data driver 120.

The timing controller 140 receives a timing signal such as a vertical synchronization signal (Vsync), a horizontal synchronization signal (Hsync), a data enable signal (DE) and a dot clock (CLK) from the host system 190, and generates the control signals (DDC, GDC) for controlling the operation timing of the driver 120 and the gate driver 130.

The gate timing control signal (GDC) includes a Gate Start Pulse (GSP), a Gate Shift Clock (GSC), a Gate Output Enable (GOE) Signal, and the like.

Data timing control signal (DDC) includes a Source Start Pulse (SSP), a Source Sampling Clock (SSC), a Polarity Control Signal (POL), a Source Output Enable (SOE) signal and the like.

The timing controller 140 detects a preset moving image input based on a Panel Self Refresh signal (hereinafter referred to as a PSR signal) applied from the host system 190, and operates differently depending on the case of the image changes continuously and the case of a static image. That is, when the image continuously changes, the corresponding image is transmitted per each frame (LRR—Off, LRR—Setting 0).

On the other hand, in the case of the static image, the static image can be operated by skipping some frame (LRR—On, LRR Setting 2, 3), or in the interlace method (LRR—On, LRR Setting 1) which displays an image only in some scan line in the frame. It is referred to as a low refresh rate mode.

In addition, in this specification, the timing controller is configured to control a polarity according to a ratio of a display frame and a skip frame in a frame skip process. That is, the timing controller 140 sets D display frame and S skip frame in N frame configuring a group of a unit on a low refresh rate mode, and controls a polarity change of the pixels in the skip frame according to the ratio of D and S.

The group of the unit may be a "period" in FIG. 3. The group may be one unit configured of the display frame and the skip frame, and means a unit in which one or more skip frames are displayed after one or more display frames are displayed. Thus, from a start time point of a first display frame to an end time point of a last skip frame may be one group or one period.

Of the signals applied to data driver 120 by the timing controller 140, an Analog Block Disable Enable (ABDEN) performs the control so that a charging is not required during a skip period, and performs a rising at a skip frame section or a time point which the frame is changed. Hereinafter, the signal which is displayed as a specific value corresponding to the skip frame in a low refresh rate of a frame skip as a signal provided to data driver 120 of a panel is referred to as a skip frame enable signal and is referred to as ABDEN as an exemplary aspect of the present disclosure.

When a moving image is continuously displayed, the ABDEN can be momentarily applied with a rising and a falling at a boundary point between the frames. An exemplary aspect of the present disclosure is to change the polarity according to an ABDEN signal as an exemplary aspect. Another aspect of the present disclosure is to change the polarity for each display frame and skip frame according to another aspect.

The timing controller 140 may set to operate on the low refresh rate mode using the PSR signal. In addition, the timing controller 140 can set to operate on a low refresh rate mode by comparing RGB information of an image to be applied in future by frame. The timing controller 140 may start or end the setting of the low refresh rate mode in various ways, and the present disclosure is not limited thereto.

FIGS. 5 to 8 are views illustrating a process of controlling a polarity according to a ratio of a display frame and a skip frame in a frame skip process by a timing controller in accordance with an aspect of the present disclosure.

Each signal which is applied to a panel from a section in which data is displayed in a data driver 120, that is, a display frame, and a section in which data is displayed in a data driver 120, that is, a skip frame indicated by 'Data" and "Skip", respectively. Including the display frame and the skip frame until a next display frame is displayed, after one display frame is displayed can be referred to as a "Group". These groups correspond to the "Period" previously reviewed in FIG. 3. Previously, the P can be set up to 3, and in FIGS. 5 to 8, an operation aspect of a low refresh rate mode will be reviewed in three P, i.e., three groups. In addition, the ratio of the display frame and the skip frame is D:S.

In addition, when the polarity is a positive polarity for each frame, it is indicated by "+", and when the polarity is a negative polarity, it is indicated by "−". On the other hand, the lines from which the gate driver 130 and data driver 120 displays a signal in the display frame are all the gate and data lines, and are therefore indicated by "All line". On the other hand, in the skip frame, the gate driver 130 performs a masking and data driver 120 performs a clock training, and does not display a signal which drives a liquid crystal. It is indicated by "M".

When driving an LRR method, the timing controller 140 can perform the control of the liquid crystal of the panel. That is, the section (the display frame) displayed on the panel and the skipped section can be controlled by data applied in the data driver, and the ABDEN signal is used to control the section. In the present disclosure, a process of preventing the polarity bias by controlling the polarity using the ABDEN is presented.

Figure 5:
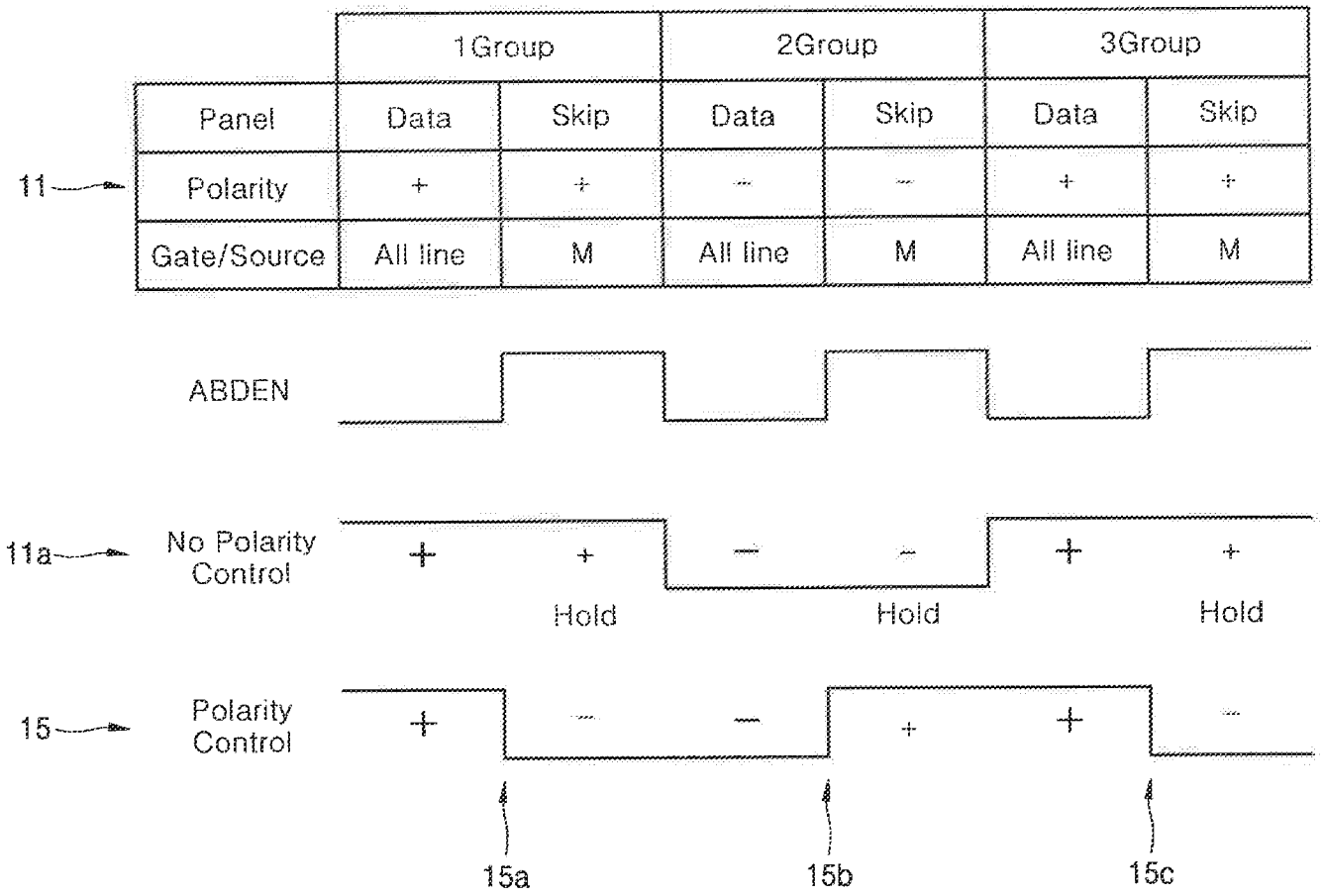
FIGS. 5 to 8 are views illustrating a process of controlling a polarity according to a ratio of a display frame and a skip frame in a frame skip process in accordance with an exemplary aspect of the present disclosure.

FIG. 5 illustrates that a size ratio of a display frame and that of a skip frame is 1:1. The output of three groups will be described.

A panel shows a configuration in which a section which data is displayed ("Data") and a skip section ("Skip") are alternately arranged. In the case where the present disclosure is not applied thereto, as indicated in 11, the polarity of the display section in which the signal for displaying the image is applied to all gate line/data line (or the "Data" section in which a data signal is applied to the data line) is maintained as that of the skip section ("Skip").

The ABDEN which is a signal of stopping a charging, as a signal of stopping a display of data for a predetermined time performs a rising at a start of the "Skip" section and performs a falling when the "Skip" section ends. The aspect of the present disclosure shows the aspect which changes the polarity when the ABDEN signal performs a rising as illustrated in 15.

In a time point 15*a*, 15*b*, 15*c* of a rising of the ABDEN signal (ABDEN Rising), the timing controller 140 or the data driver 12 according to the aspect of the present disclosure changes the polarity. As a result, in a skip section of a first group (1Group), the polarity becomes "−". However, in a falling of the ABDEN signal, the polarity is not changed, and thus, the polarity in a data section of a second group (2Group) is maintained as "−", which is identical to the polarity that has to be displayed originally (the polarity of the 2Group indicated in 11).

In addition, when an ABDEN signal corresponding to the skip section of the 2Group is rising, the polarity is similarly changed, and the polarity of a 2Group-Skip section becomes "+". In addition, in a 3Group-Data section, the polarity is maintained as "+".

FIG. 5 shows an aspect in which the timing controller 140 changes the polarity of the pixels in a rising of the ABDEN signal, which is an aspect of a skip frame enable signal for blocking the data signal corresponding to the skip frame. This allows the polarity to be changed even in the skip section. Since the ABDEN is a signal for activating the skip frame in the low refresh rate mode, it is possible to control the polarity of the pixels to be changed at the most precise time when the polarity of the pixels is changed corresponding thereto.

When the polarity change is operated only in accordance with the polarity of the "Data" section irrespective of a rising time point of the ABDEN signal, the skip section holds the polarity in the previous data section as itself as indicated by a reference numeral 11*a*.

Figure 6:
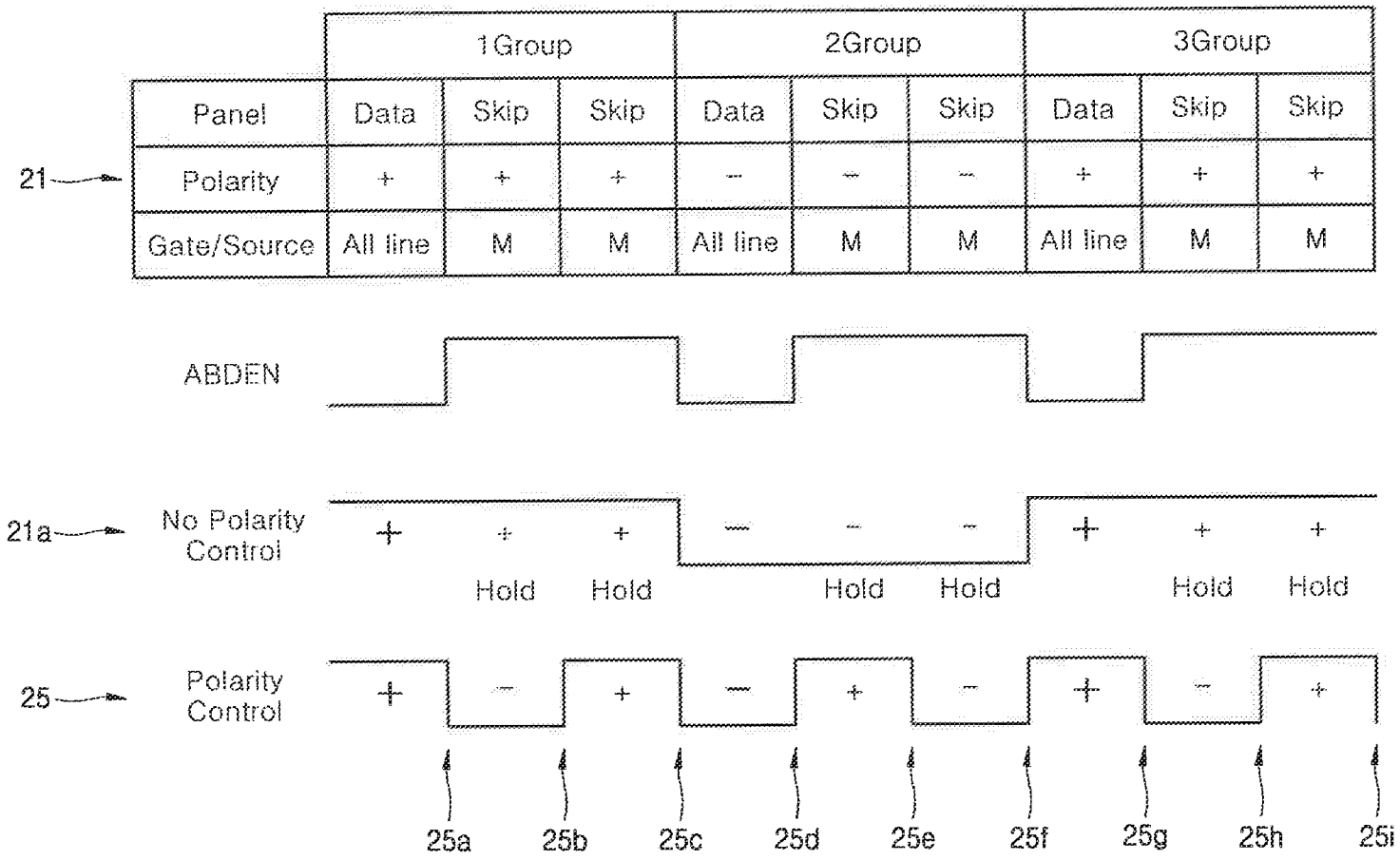

FIG. 6 shows that a size ratio of a display frame and that of a skip frame in accordance with another aspect of the present disclosure is 1:2. The output of three groups will be described.

A panel shows a configuration in which a data display section ("Data") and a skip section ("Skip") are arranged in 1:2. When the present disclosure is not applied thereto, as indicated in a reference numeral 21, a polarity of a display section to which a signal for displaying an image is applied to all gate line/data line (or "Data" section to which data signal is applied to data line) is maintained as that of the skip section ("Skip").

An ABDEN which is a signal of stopping a charging, as a signal of spotting a display of data for a predetermined time performs a rising at a start of the "Skip" section and performs a falling when the "Skip" section ends. In addition, the ABDEN maintains a high state during two frame sections longer than one frame section. The aspect of FIG. 6 shows changing the polarity for each frame unlike FIG. 5.

In the aspect of the present disclosure, the aspect which changes the polarity according to each frame section of the skip section that an ABDEN signal is high is shown as in a reference numeral 25. In the skip section which the ABDEN signal is the high section (ABDEN high), a timing controller 140 or a data driver 120 according to an exemplary aspect of the present disclosure changes the polarity at a boundary time point of the frame. Of course, since a data section that the ABDEN signal is low is also a boundary time point of the frame, it changes the polarity.

As a result, in a skip section of a first group, at a time point that 25*a* and 25*b* indicate, the polarity is changed, and the polarity of each skip section becomes "−" and "+". In a data section of a second group (2Group), as indicated by 25*c*, it enters into the boundary time point of the frame again and the polarity is maintained as "−", which is identical to "−" which is the polarity that has to be displayed originally (the polarity of 2Group indicated in a reference numeral 21).

In addition, likewise a skip section of the 2Group, the polarity is changed at each frame boundary 25*d*, 25*e* and two 2Group-Skip sections become "+" and "−", respectively.

Even in a 3Group-Data section and the Skip sections, the polarity is changed at the boundary points 25*f*, 25*g*, and 25*h* of the frame, as shown.

In FIG. 6, it is possible to change the polarity at the boundary for each frame and makes the polarity change even in the skip section. When the polarity change is operated only according to the polarity of the "Data" section irrespective of the frame boundary, the skip section holds the polarity in the previous data section as itself as indicated in 21*a*.

In summary, when the skip section is an even number in FIG. 6 as an exemplary aspect of the present disclosure, FIG. 6 shows a process of changing the polarity for each skipped frame.

Figure 7:
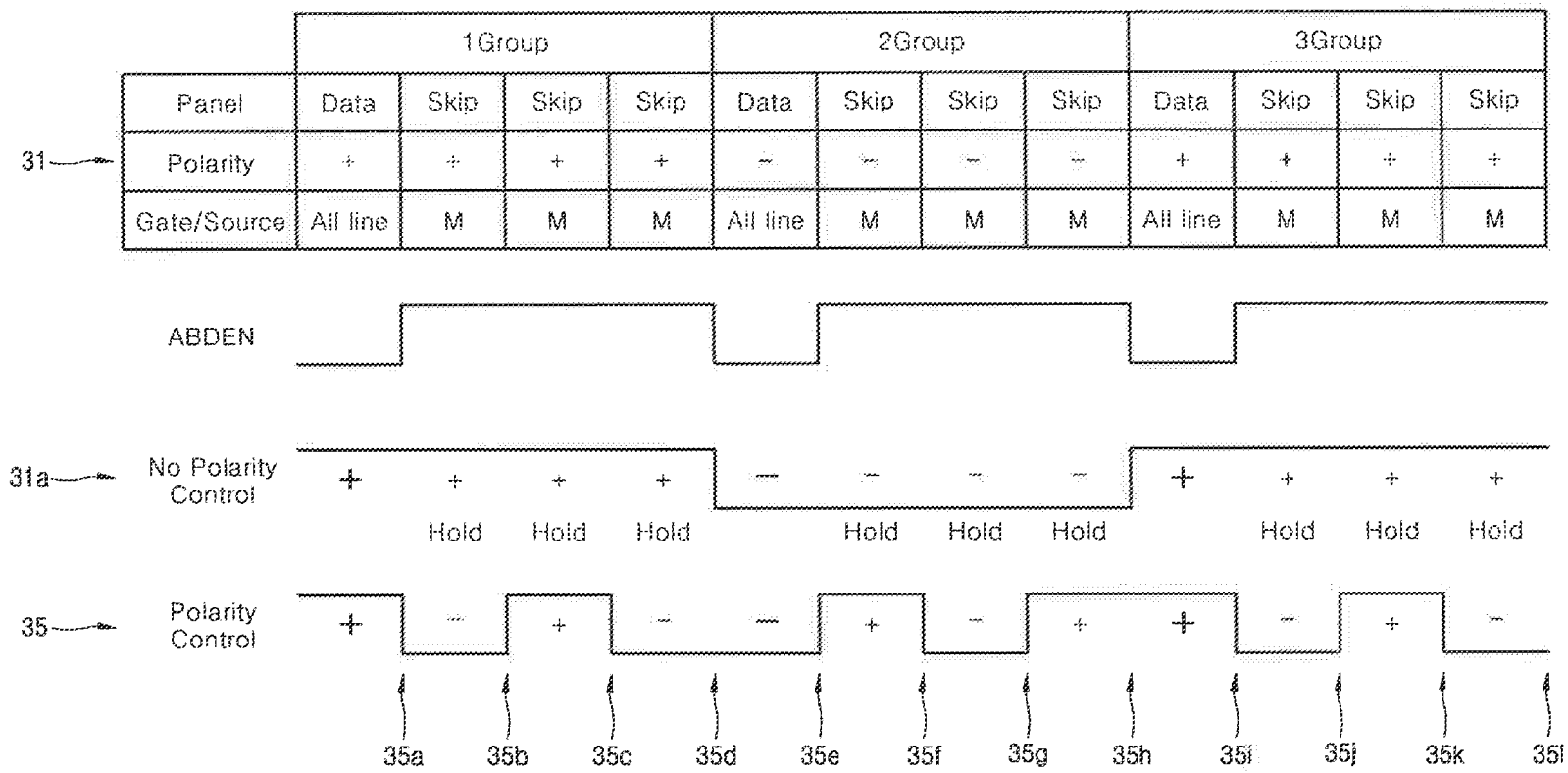

FIG. 7 shows that a size ratio of a display frame and that of a skip frame in accordance with an exemplary aspect of the present disclosure is 1:3. The output of three groups will be described.

A panel shows a configuration in which a data display section ("Data") and a skip section ("Skip") are arranged in 1:3. When the present disclosure is not applied thereto, as indicated in 31, a polarity of a display section to which a signal for displaying an image is applied to all gate line/data line (or a "Data" section to which a data signal is applied to a data line) is maintained as a polarity of the skip section ("Skip").

An ABDEN which is a signal of stopping a charging, which is a signal of stopping a display of data for a predetermined time performs a rising at a start of the "Skip" section and performs a falling when the "Skip" section ends. In addition, a high state is maintained during three frame sections longer than one frame section. The aspect of FIG. 7 is described by combining FIG. 6 and FIG. 5 and a polarity is changed at a time of rising of the ABDEN and is changed for every frame, and is not changed at a time of a falling of the ABDEN.

First, a first group (1Group) is described. A data section has a polarity of "+". As the ABDEN performs the rising and enters into the skip section, the polarity is changed as indicated in 35*a*. Since the ABDEN maintains high in the next skip section, the polarity is changed as indicated in 35*b*. In addition, the ABDEN maintains the high state also in the next skip section, the polarity is changed as indicated in 35*c*.

Then, it enters into a data section of a second group (2Group). At this time, as indicated in 35*d*, the ABDEN is a boundary section of a falling frame. At this time, the polarity is maintained without being changed. As a result, the data section of 2Group maintains the polarity as "−".

Likewise, in three skip sections of the second group (2Group), the polarity is changed at a time point 35*e* at which the ABDEN is rising and at a time point 35*f*, 35*g* at which the ABDEN remains high. However, at a time point 35*h* when the ABDEN falls, the polarity is maintained without being changed. As a result, a data section of the third group maintains the polarity as "+".

In FIG. 7, it is possible to change the polarity at the border of for each frame at a time point that the ABDEN performs a rising and the ABDEN maintains high, so that the polarity can be changed even in the skip section. On the other hand, at the time when the ABDEN falls, the polarity is not changed, which makes the polarity of the next data section be displayed corresponding to an original polarity. When the polarity change is operated only according to the polarity of the "Data" section, irrespective of the frame boundary, the skip section holds the polarity of the previous data section as itself as indicated in 31*a*.

In summary, when the skip section is an odd number in FIG. 7 as an exemplary aspect of the present disclosure, it shows a process of changing the polarity at a time point except the section in which the ABDEN performs the falling of the skip frames.

Figure 8:
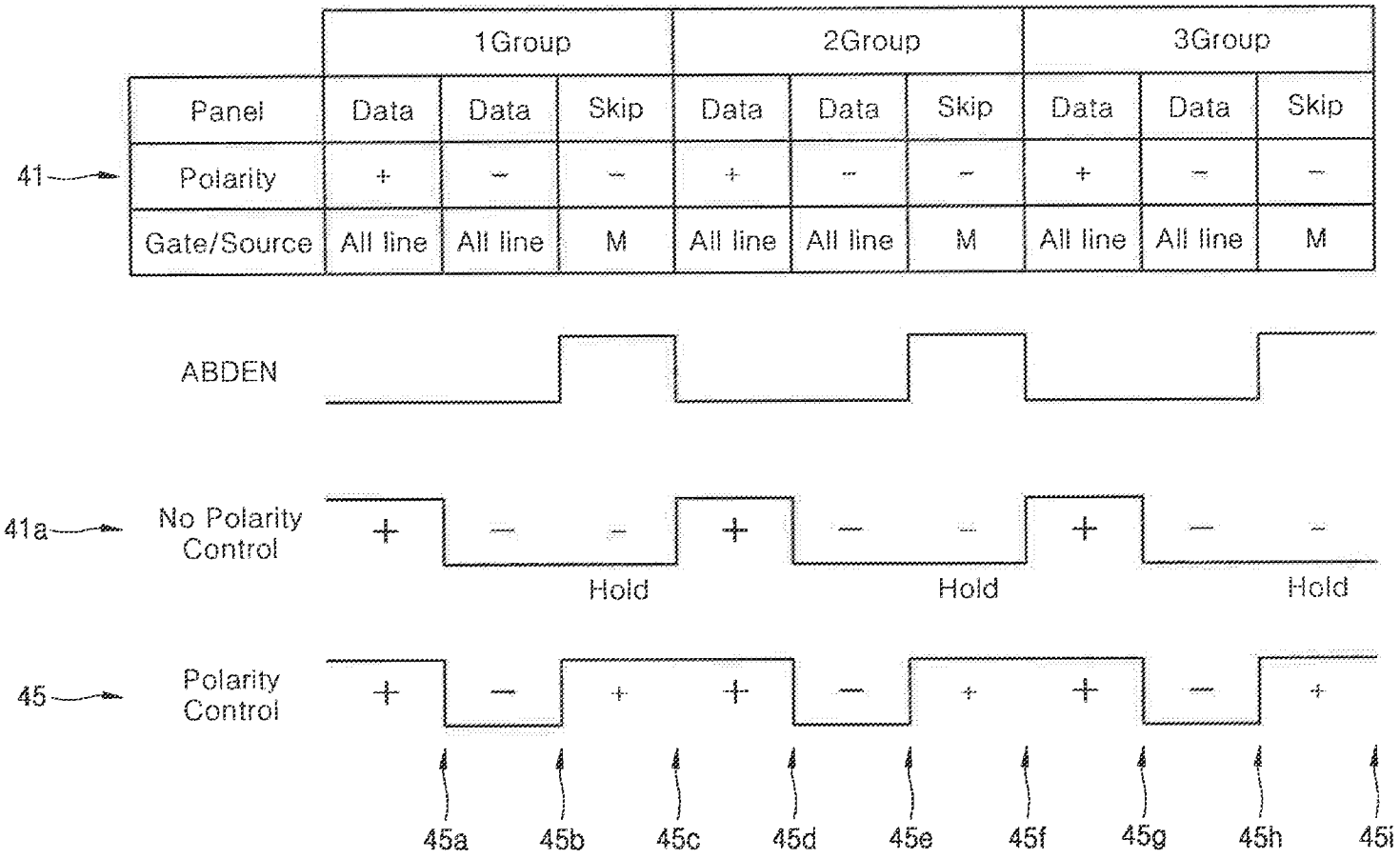

FIG. 8 shows that a size ratio of a display frame and that of a skip frame is 1:2. The output of three groups will be described.

A panel shows a configuration in which a data display section ("Data") and a skip section ("Skip") are alternately arranged. When the present disclosure is not applied thereto, as indicated in 41, a polarity of a display section which a signal for displaying an image is applied to all gate line/data line (or a "Data" section which a data signal is applied to data line) is maintained as that of the skip section ("Skip").

The display section is arranged continuously, and the polarity is changed in each display section. In the following skip section, a timing controller changes the polarity of the pixels of the panel such as 45 in a rising time point of an ABDEN which is a signal of stopping a charging, as a signal of stopping a display of data for a predetermined period.

The timing controller 140 or the data driver 120 in accordance with an exemplary aspect of the present disclosure changes the polarity of the pixels of the panel in a skip frame section in the time point, i.e. 45*b*, 45*e*, 45*h* of a rising of an ABDEN signal (ABDEN, Rising). As a result, the polarity becomes "+" in a Skip section of a first group (1Group). However, at a time of a falling of the ABDEN signal, that is 45*c*, 45*f*, 45*i*, the polarity is not changed, and thus, the polarity is maintained as "+" in a data section of the second group (2Group), which is identical to "+" which is the polarity which has to be displayed originally (the polarity of 2Group indicated in 41).

In FIG. 8, it is possible to change the polarity even in the skip section by changing the polarity at the time of rising of the ABDEN signal. When the polarity change is operated only in accordance with the polarity of the "Data" section irrespective of the rising time point of the ABDEN signal, the skip section holds the polarity in the previous data section as itself as indicated in 41*a*.

As in FIG. 8, when D is an even number and S is an odd number, the timing controller 140 maintains the polarity of the pixels at a time point at which a last skip frame of the group ends such that the polarity of the following display frame is displayed in accordance with the original polarity. The polarity is maintained or held after displaying the last skip frame such that the original polarity which is set in the display frame is maintained. This can prevent a misoperation generated from the polarity of the display frame being changed in the low refresh rate mode process.

The aspects of FIGS. 5 to 8 are summarized as follows.

In a general mode of displaying a moving image, the polarity is changed for every frame. On the other hand, on the low refresh rate mode including a display frame to display an image and a skip frame to display no image, when the polarity is not changed for each frame, a problem of the polarity being biased in one way is generated. In order to solve this problem, as shown in FIGS. 5 to 8, the polarity may be changed or not changed in the display frame and the skip frame according to the polarity and the ABDEN signal.

That is, it is possible to control the displayed section and the skipped section in the panel by data and the polarity can be changed even in the skip section as shown in FIGS. 5 to 8 while controlling the display and the skip by using the ABDEN signal such that the polarity is not biased and a flickering is prevented.

In order to control the time point of the polarity change according to the ratio of D and S (display-skip frame ratio), a data setting can be set as to whether to change the polarity change or hold the polarity as shown in FIG. 2. In addition, in holding/changing the polarity by using an additional data transistor, the polarity bias can be compensated by controlling the polarity by groups.

Summarizing the embodiments of the present disclosure, at the start point of the skip frame on the low refresh rate mode of the frame skip method, the timing controller changes the polarity of the panel. In addition, at the time point for each skip frame, the timing controller changes the polarity of the start time point. That is, the timing controller always changes the polarity of the pixels at a start point of S skip frame such that the polarity of the pixels is not fixed even if the skip frame is displayed continuously in order to remove a flickering phenomenon and a Direct Current (DC) component.

On the other hand, according to the ratio of D and S, the polarity of the panel is changed or maintained at the time of changing from the skip frame to the display frame.

That is, the timing controller 140 changes the polarity of the pixels at a start time point of one or more skip frames followed by the display frame such that the DC component is not remained even if the number of the skip frame is increased and the flickering phenomenon can be reduced or removed.

This ratio can be varied according to whether D (the number of the display frame) is an odd number or an even number and S (the number of the skip frame) is an odd number or an even number. It can be described in Table as follows.

TABLE 1

| D | S | At a start of each skip frame | At an end of a last skip frame |
|---|---|---|---|
| Odd number | Odd number | Changing the polarity | Maintaining the polarity |
| Odd number | Even number | Changing the polarity | Changing the polarity |
| Even number | Odd number | Changing the polarity | Maintaining the polarity |

In Table 1, at a start of a first skip frame, the timing controller 140 can change the polarity at a time point that the signal such as the ABDEN becomes high, i.e. a rising edge (a rising time point). In addition, the timing controller 140 can change the polarity at a start of the following skip frames.

Meanwhile, the timing controller 140 can select the polarity change or the polarity maintaining according to the polarity of the last skip frame and that of the display frame followed when the last skip frame ends. As a result, the polarity thereof coincides with that of the original display frame.

As reviewed in FIGS. 5, 7 and 8, the timing controller 140 maintains the polarity of the pixels when the polarity of the last skip frame of 1Group is identical to that of the first display frame of 2Group. This maintains the polarity after displaying the last skip frame such that the original polarity which is set in the display frame is maintained. This can prevent the misoperation due to the change of the polarity of the display frame in the low refresh rate mode process.

For example, when D is an odd number and S is an even number, the timing controller 140 can change the polarity at a time point that the signal such as the ABDEN is low, that is a falling edge (a falling time point). This means a time point that the display frame starts after the end of the last skip frame of the group (or the period). When the timing controller 140 controls to change the polarity in the falling edge, the polarity is changed at the end time point of the skip frame.

Since the ABDEN as an exemplary aspect of the skip frame enable signal which blocks the data signal is the signal which activates and inactivates the skip frame in the low refresh rate mode, it is possible to change the polarity of the pixels at the most precise time point when the polarity of the pixels is changed corresponding thereto. Therefore, the time point which the ABDEN inactivates the skip frame, for example the falling of the ABDEN, the timing controller changes the polarity of the pixels such that the polarity of the pixels of the display panel is controlled.

Since the meaning that S is an even number indicates that the polarity of the last skip frame is opposite to that of the next display frame to be displayed, the timing controller 140 changes the polarity of the pixels such that the polarity of the display frame is not different from the polarity which is originally planned to block the misoperation.

On the other hand, when S is odd number, the timing controller 140 maintains the polarity without being changed at a time point that the display frame starts after the end of the last skip frame such that the polarity thereof coincides with that of the original display frame. Since the meaning that S is an odd number indicates that the polarity of the last skip frame is identical to that of the next display frame to be displayed, the timing controller 140 maintains the polarity of the pixels such that the polarity of the display frame is different from the polarity which is originally planned in order to block the misoperation.

Figure 9:
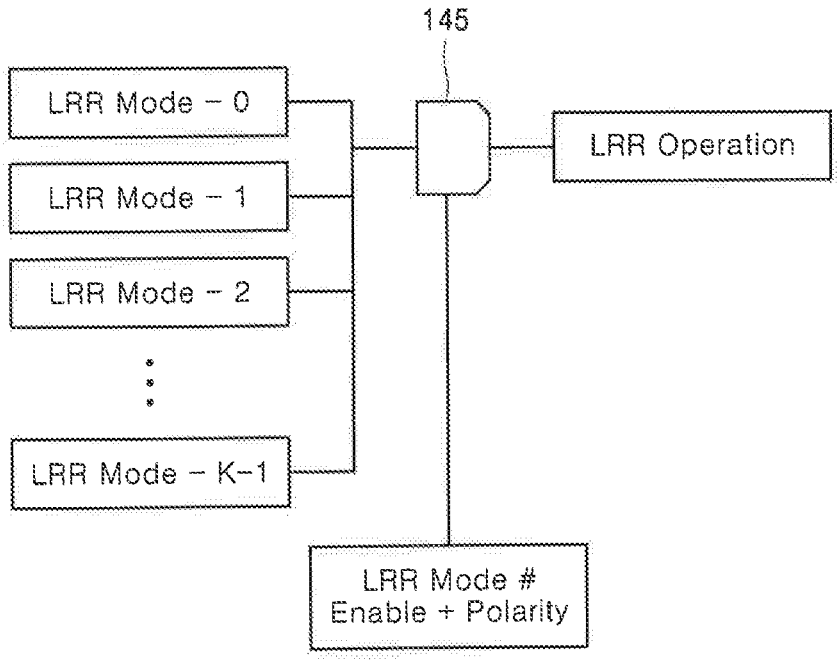
FIG. 9 is a view illustrating a relationship of information to be referred in a process of operating on a low refresh rate mode by a timing controller in accordance with an exemplary aspect of the present disclosure.

FIG. 9 is a view illustrating a relationship of information to be referred to in a process of a timing controller operating on a low refresh rate mode in accordance with an exemplary aspect of the present disclosure. An LRR control part 145 of controlling a low refresh rate mode in the timing controller may have a total of K low refresh rate mode. The LRR control part 145 receives a set value of one or more low refresh rate modes and a set value of controlling a polarity change and controls the low refresh rate driving of a display panel corresponding thereto. The detailed description is as follows.

It starts from LRR Mode 0 to LRR Mode K−1. In one aspect, it is assumed that K is 4. In this case, LRR Mode—0 may indicate that the LRR drive is not driven, that is, the low refresh rate mode is off. In addition, LRR Mode 1 can instruct a static image to be displayed in an interlace method on a low refresh rate mode.

LRR Mode 2 can instruct a low refresh rate mode to output the static image in a frame skip mode. LRR Mode 3 means that a static image is displayed in a frame skip scheme of a low refresh rate mode and controls a display frame and a skip frame corresponding to other signal.

The LRR mode can be set in various ways, and only a part of the LRR mode can be set or a larger number of LRR modes can be set by reflecting a characteristic of a panel or a host system.

The LRR control part 145 can receive indicating information (LRR Mode # Enable) as to which mode can be selected of the preset K LRR modes and information (Polarity) as to whether to change the polarity in the low refresh rate mode and generate the control signal to perform the LRR operation. The polarity which is information with regard to the change of the polarity includes information as to whether to change the polarity in the skip frame as suggested in FIG. 3.

Whether to change the polarity can be determined in advance according to the LRR mode and the ratio of the display frame and the skip frame, etc. Alternatively, the timing controller confirms that a DC component increases in the display panel such that whether to change the polarity is determined in a skip mode of the low refresh rate mode.

As described above, it is possible to reduce the power consumption by variously adjusting the ratio of the display frame and the skip frame on the low refresh rate mode such as frame skip. Further, according to the aspect of the present disclosure, by changing the polarity in the skip frame, it is possible to eliminate the flicker phenomenon that may occur due to the different ratio of the display frame and the skip frame.

Particularly, it is possible to apply the low refresh rate mode such as a frame skip to a display panel using a-Si TFT as well as an oxide TFT while adjusting various frame ratios by removing the flicker phenomenon. The frame rate can be set separately by the user.

For example, in the low refresh rate mode, conventionally, the display and skip rate is limited to only 1:1 to prevent an accumulation of the DC component. When the ratio of the display frame is different from that of the skip frame (for example, 2:1 or 1:2, etc.), the DC component may be accumulated. In particular, the flickering in a gray pattern could be increased due to an increase of a flickering component in a low frequency band. Therefore, the display and skip ratio was limited to 1:1 for a visibility improvement. This has become a barrier in reducing the power consumption.

However, when the aspects of the present disclosure are applied, the skip frame can be implemented on the low refresh rate mode at various ratios, thereby reducing the power consumption. In particular, a skip frame longer than a display frame can be implemented, which enables a large reduction in the power consumption. At the same time, the flickering phenomenon caused by the residual DC component due to the accumulation of skip frames can be removed.

Figure 10:
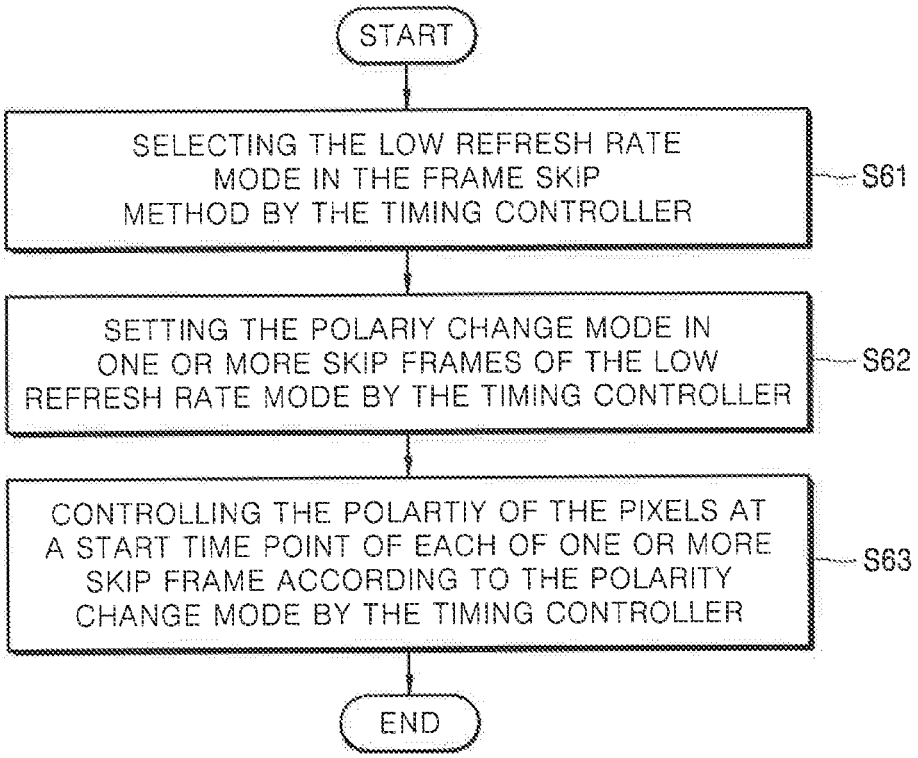
FIG. 10 is a view illustrating a process in which a timing controller controls a polarity in a skip frame on a low refresh rate mode based on information on data setting in accordance with an exemplary aspect of the present disclosure.

FIG. 10 is a view illustrating a process in which a timing controller in accordance with an exemplary aspect of the present disclosure controls a polarity in a skip frame on a low refresh rate mode based on information on a data setting.

A flowchart of FIG. 10 shows an operation process of the display device of FIG. 4 and the timing controller 140 included in the display. The timing controller 140 selects a low refresh rate mode of a frame skip method (S61). As described previously, an exemplary aspect of the present disclosure is to select the LRR mode. In addition, it is possible to set the number of the skip frame and the number of the display frame. The timing controller 140 can select a set value of a preset low speed mode setting value as shown in FIGS. 3 and 9.

Next, the timing controller 140 sets the polarity change mode in one or more skip frames of the low refresh rate mode (S62). As shown in FIG. 3, an exemplary aspect of the present disclosure is to select whether to hold the polarity or the change the polarity in the skip frame. According to the situation such as the case which the length of the skip frame is too short, or the DC residual component is not large, the timing controller 140 can maintain the polarity in the skip frame.

In addition, the timing controller 140 can change the polarity in the skip frame in such a condition confirming that the entire skip frame increases or the DC residual component increases.

The timing controller 140 may then control the polarity of the pixels at the start time point of each of one or more skip frames, depending on the polarity change mode (S63). More specifically, when the polarity change mode is set to change the polarity in the skip frame, the polarity of the pixels is changed at the start time point of each skip frame.

When the polarity change mode is set to maintain (Polarity-Hold) in the skip frame without being changed, the timing controller 140 does not perform separate polarity change at the start and the end time points of each skip frame and maintains the polarity of the display frame as itself. In this case, after the last skip frame of the group or the period ends, it enters into the display frame section and the timing controller 140 can change the polarity.

While the aspects of the present disclosure have been mainly described, various changes or modifications can be made at a level of those skilled in the art. It is therefore to be understood that such changes and modifications are included within the scope of the present disclosure unless these changes and modifications do not deviate therefrom.

What is claimed is:

1. A display device, comprising:

a display panel where a plurality of gate lines and data lines are crossed each other and a plurality of pixels is defined;

a gate driver supplying a first signal to the plurality of gate lines;

a data driver supplying a second signal to the plurality of data lines; and a timing controller setting D number of display frame and S number of skip frame within N number of frame constituting a unit group in a low refresh rate mode and controlling a polarity change of the plurality of pixels in the S number of skip frame, where D, S, and N are natural numbers, wherein the timing controller maintains a polarity of the plurality of pixels at an end time point of a last skip frame of the unit group when S is an odd number and changes a polarity of the plurality of pixels at the end time point of the last skip frame of the unit group when D is an odd number and S is an even number.

2. The display of claim 1, wherein the timing controller changes a polarity of the plurality of pixels at a start time point of a first skip frame of the unit group.

3. The display of claim 1, wherein the timing controller changes a polarity of the pixels in a rising of a skip frame enable signal for blocking a data signal corresponding to the S number of skip frame.

4. The display of claim 1, wherein the timing controller changes a polarity of the plurality of pixels at a start time point of each of the S number of skip frame of the unit group.

5. The display of claim 1, wherein the timing controller maintains a polarity of the plurality of pixels when a polarity of a last skip frame of a first group is same as that of a first display frame of a second group.

6. The display of claim 1, wherein the timing controller changes the polarity of the pixels in a falling of a skip frame enable signal which blocks a data signal corresponding to the S number of skip frame when D is an odd number and S is an even number.

7. The display of claim 1, wherein the timing controller includes a low refresh rate (LRR) control part receiving a set value of one or more low refresh rate modes and a set value which controls the polarity change, and controls a low refresh rate drive of the display panel.

8. A method of displaying an image on a low refresh rate mode for a display which includes a display panel where a plurality of gate lines and data lines are crossed each other and a plurality of pixels is defined, a gate driver supplying a first signal to the plurality of gate lines, a data driver supplying a second signal to the plurality of data lines, and a timing controller supplying a signal to control the gate driver and the data driver, selecting a low refresh rate mode in a frame skip scheme by the timing controller;

setting D number of display frame and S number of skip frame in N number of frame constituting a unit group in the low refresh rate mode by the timing controller, where D, S, and N are natural numbers;

maintaining the polarity of the plurality of pixels at an end time point of a last skip frame of the group when S is an odd number by the timing controller; and changing the polarity of the plurality of pixels at the end time point of the last skip frame of the group when D is an odd number and S is an even number by the timing controller.

9. The method of claim 8, further comprising changing the polarity of the pixels at the start time point of a first skip frame of the unit group by the timing controller.

10. The method of claim 9, wherein the changing the polarity of the pixels at the start time point includes changing the polarity of the pixels in a rising of a skip frame enable signal which blocks a data signal corresponding to the one or more skip frames by the timing controller.

11. The method of claim 8, further comprising changing the polarity of the pixels at a start time point of each of S number of skip frame of the unit group by the timing controller.

12. The method of claim 8, wherein the maintaining the polarity of the pixels maintains the polarity of the pixels by the timing controller when the polarity of a last skip frame of a first group is same as that of the first display frame of a second group.

13. The method of claim 8, wherein the changing the polarity of the pixels includes changing the polarity of the pixels in a falling of a skip frame enable signal by the timing controller in a falling of a skip frame enable signal to block to data signal corresponding to the one or more S number of skip frame.

* * * * *